US006929520B1

(12) United States Patent
Hughes et al.

(10) Patent No.: US 6,929,520 B1
(45) Date of Patent: Aug. 16, 2005

(54) COOLING METHOD FOR A MARINE PROPULSION SYSTEM

(75) Inventors: William E. Hughes, Perry, OK (US); Dennis M. McClurg, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/858,802

(22) Filed: Jun. 2, 2004

(51) Int. Cl.[7] ..... B63H 21/10
(52) U.S. Cl. ..... 440/88 G; 440/89 B
(58) Field of Search ..... 440/88 G, 88 J, 440/89 R, 89 B, 89 C

(56) References Cited

U.S. PATENT DOCUMENTS

| | | | | |
|---|---|---|---|---|
| 4,977,741 A | | 12/1990 | Lulloff et al. | 60/310 |
| 4,991,546 A | | 2/1991 | Yoshimura | 123/41.31 |
| 5,109,668 A | | 5/1992 | Lindstedt | 60/310 |
| 5,148,675 A | | 9/1992 | Inman | 60/321 |
| 5,885,121 A | * | 3/1999 | Nanami et al. | 440/88 R |
| 6,024,617 A | * | 2/2000 | Smullin et al. | 440/89 R |
| 6,290,558 B1 | | 9/2001 | Erickson | 440/89 |
| 6,368,169 B1 | | 4/2002 | Jaeger | 440/88 |
| 6,379,201 B1 | | 4/2002 | Biggs et al. | 440/88 |
| 6,582,263 B1 | | 6/2003 | Jaeger et al. | 440/89 C |
| 6,644,024 B1 | | 11/2003 | Powers et al. | 60/320 |
| 6,652,337 B1 | | 11/2003 | Logan et al. | 440/88 J |
| 6,672,919 B1 | | 1/2004 | Beson | 440/89 R |

* cited by examiner

*Primary Examiner*—Stephen Avila
(74) *Attorney, Agent, or Firm*—William D. Lanyi

(57) ABSTRACT

A method for cooling a marine propulsion system directs a portion of a recirculating stream of cooling water to a first port of an exhaust manifold so that a cooling jacket of the exhaust manifold can be maintained in a filled condition. Water flows upwardly through the cooling jacket and exits through a port in the exhaust manifold back into the recirculating stream of cooling water that passes through a recirculation pump, the cooling passage of an engine, and a cavity of a thermostat housing.

8 Claims, 2 Drawing Sheets

COOLING METHOD FOR A MARINE PROPULSION SYSTEM

BACKGROUND OF THE INVENTION

1. Field of the Invention

The present invention is generally related to the cooling arrangement for a marine propulsion system and, more particularly, to a method for conducting cooling water through the engine, through exhaust manifolds, and through a thermostat housing while maintaining a recirculating cooling water path through the engine block and cylinder heads.

2. Description of the Prior Art

Those skilled in the art of marine propulsion systems are aware of many different ways in which cooling water can be circulated through various heat producing components before being conducted back into a body of water from which it was drawn.

U.S. Pat. No. 4,991,546, which issued to Yoshimura on Feb. 12, 1991, describes a cooling device for a boat engine. A number of embodiments of cooling systems for internal combustion engines powering marine watercraft are described. The engine cooling jacket delivers its coolant to an exhaust manifold cooling jacket adjacent the inlet end of the exhaust manifold and coolant is delivered from the exhaust manifold cooling jacket to a further cooling jacket around the inlet portion of an exhaust elbow. In one of the embodiments, a closed cooling system is provided for the engine cooling jacket, exhaust manifold cooling jacket and the elbow cooling jacket. In another embodiment, the system discharges coolant back to the body of water in which the watercraft is operating through a further cooling jacket of the exhaust elbow that communicates with its discharge end.

U.S. Pat. No. 6,368,169, which issued to Jaeger on Apr. 9, 2002, discloses a marine engine cooling system with a siphon inhibiting device. The siphon inhibiting valve is provided for a marine engine cooling system. The purpose of the valve is to prevent the draining of the pump and outboard drive unit from creating a siphon effect that draws water from portions of the cooling system where heat producing components exist. The valve also allows intentional draining of the system when the vessel operator desires to accomplish this function. The valve incorporates a ball that is captivated within a cavity. If the ball is lighter than water, its buoyancy assists in the operation of the valve.

U.S. Pat. No. 6,379,201, which issued to Biggs et al. on Apr. 30, 2002, discloses a marine engine cooling system with a check valve to facilitate draining. The cooling system is provided with a valve in which a ball moves freely within a cavity formed within the valve. Pressurized water, from a sea pump, causes the ball to block fluid flow through the cavity and forces pumped water to flow through a preferred conduit which may include a heat exchanger. When the sea pump is inoperative, the ball moves downward within the cavity to unblock a drain passage and allow water to drain from the heat generating components of the marine engine.

U.S. Pat. No. 6,644,024, which issued to Powers et al. on Nov. 11, 2003, discloses an exhaust system for a marine engine. An exhaust system for a marine engine provides individual exhaust gas conduits that are maintained separately from water conduits until the individual exhaust gas conduits can be combined within a common exhaust gas conduit. This combination of exhaust gas streams allows the amplitude of negative pressure pulses to be damped, by combination with each other, prior to the mixing of cooling water with the exhaust gas streams. Later, the combined exhaust gas stream can be mixed with a combined water stream.

U.S. Pat. No. 6,672,919, which issued to Beson on Jan. 6, 2004, describes a temperature control system for a marine exhaust. The control system lowers flow of cooling water to the water jacket and exhaust gas conduit of the exhaust system at low engine speeds. The control system is typically activated at and below a predetermined engine speed. Once activated, the control system operates to reduce flow of cooling water to the exhaust system. The control can operate in an on/off mode, or can modulate rate of flow of water through the exhaust system, or both. However the water flow is limited, a predetermined minimum flow of cooling water is maintained through the exhaust system, at least either at periodic levels, or at a constant but lowered rate, to maintain cooling in the exhaust system on rubber components of the exhaust system.

U.S. Pat. No. 4,977,741, which issued to Lulloff et al. on Dec. 18, 1990, discloses a combination exhaust manifold and exhaust elbow for a marine propulsion system. The combined manifold and elbow for an internal combustion engine includes an exhaust cavity for receiving exhaust from the engine, an exhaust passage leading from the exhaust cavity, and an exhaust discharge outlet. A first water jacket is provided around the exhaust cavity and a second water jacket is provided around the exhaust discharge passage.

U.S. Pat. No. 5,109,668, which issued to Lindstedt on May 5, 1992, discloses a marine exhaust manifold and elbow. The exhaust assembly includes a manifold portion, an elbow portion, a water jacket portion, and exhaust runner walls, providing a smooth continuous transition of exhaust gas flow from intake exhaust passages in the manifold portion to transfer exhaust passages in the elbow portion around a bend to a discharge exhaust passage, minimizing turbulent flow of exhaust through the manifold portion and elbow portion.

U.S. Pat. No. 5,148,675, which issued to Inman on Sep. 22, 1992, describes a marine exhaust manifold and header pipe system. It is intended for a multi-cylinder internal combustion engine and it has a plurality of inlet ports which are connected via a cavity in the manifold to an outlet port formed in a face of the manifold. At least one septum member is disposed in the manifold to divide the cavity into at least two chambers with each of which are associated at least two inlet ports.

U.S. Pat. No. 6,290,558, which issued to Erickson on Sep. 18, 2001, discloses an exhaust elbow with a water trap for a marine propulsion system. The elbow is provided with a water trap section that defines a water collection cavity. Within the water trap section, a barrier extends downward into the water collection cavity to define first and second exhaust passages. When water begins to collect in the water collection cavity, the cross sectional area of the exhaust passage is reduced and the velocity of exhaust gases passing through the exhaust passage is increased. The water collection cavity is shaped to be easily cleared when exhaust gas pressure increases as the engine speed increases.

U.S. Pat. No. 6,582,263, which issued to Jaeger et al. on Jun. 24, 2003, discloses a marine exhaust elbow structure with enhanced water drain capability. The elbow for a marine propulsion system is provided with a stainless steel tube within a water outlet opening to assure that a drain opening remains open even when the exhaust elbow is exposed to a corrosive atmosphere. Since cast iron tends to expand in volume as a result of corrosion of its surface areas, water outlet openings intended to perform a draining function can be partially or fully closed as a result of corrosion. The insertion of a stainless steel tube in one or more water outlet openings of an exhaust elbow assures that an internal water cavity of the elbow can be drained when the associated internal combustion engine is turned off, thereby minimizing the possibility of freeze damage to the exhaust components.

U.S. Pat. No. 6,652,337, which issued to Logan et al. on Nov. 25, 2003, discloses an exhaust system for a marine propulsion engine. It provides a relationship between the exhaust passages and coolant passages of the exhaust manifold and exhaust elbow which serves to maintain the joint of the exhaust passage at a higher temperature than would be possible with known exhaust manifolds and exhaust elbows. By providing a space between surfaces of a raised exhaust portion of the components and surfaces of the raised coolant portions of the components, leakage from the coolant conduits to the exhaust cavities is avoided.

The patents described above are hereby expressly incorporated by reference in the description of the present invention.

In known cooling systems for marine propulsion devices, the coordination of cooling water flow between the engine block, cylinder head, and exhaust components, such as the exhaust manifolds and exhaust elbows, could allow unreliable cooling water flow to create hot spots in the exhaust components. During initial starting of the engine of a marine propulsion system, before the thermostat begins to open for the purpose of purging hot water from the engine, the exhaust manifolds and exhaust elbows are typically dependent on a bleed water flow to provide cooling. As these components achieve higher temperatures, typically before the engine itself achieves sufficient temperatures to open the thermostat control system, the flow of water through the exhaust manifolds and exhaust elbows can be insufficient to provide uniform cooling. In addition, known systems do not always provide a completely filled cooling water jacket around the exhaust manifolds.

It would therefore be significantly beneficial if a cooling water system could be provided for a marine propulsion system that maintains a filled cooling water jacket for both exhaust manifolds. It would also be beneficial if the pressure within those exhaust manifold cooling jackets could be maintained at an elevated magnitude to discourage boiling of the cooling water as it passes through the exhaust manifold cooling jackets. It would also be beneficial if a means could be provided to more rapidly increase the temperature flowing through the engine block and cylinder heads in order to achieve more efficient operation immediately after startup of the engine.

If a stabilized and more uniform temperature of the cooling water can be created and maintained throughout the cooling passages of the engine block and cylinder heads and the cooling jackets of the exhaust manifolds, condensation can be reduced and the efficiency of the engine operation can be improved.

SUMMARY OF THE INVENTION

A method for cooling a marine propulsion system, in accordance with a preferred embodiment of the present invention, comprises the steps of providing an engine and a cooling passage formed within the engine. The cooling passage within the engine can be any one of numerous types that provide thermal communication between a stream of cooling water and the heat producing portions of an engine block and cylinder heads. The present invention further comprises the step of attaching an exhaust manifold to the exhaust system of the engine and connecting first and second conduits in fluid communication between the cooling passage of the engine and, respectively, first and second ports of the exhaust manifold. In addition, the present invention comprises the step of creating a recirculating stream of cooling water to flow into the cooling passage of the engine, through the cooling passage, and out of the cooling passage. The present invention comprises the step of causing water to flow through the first conduit from the recirculating stream to the first port of the exhaust manifold and causing water to flow through the second conduit from the second port of the exhaust manifold to the cooling passage of the engine.

A particularly preferred embodiment of the present invention further comprises the step of providing a recirculation pump connected in fluid communication between the second port of the exhaust manifold and the cooling passage to induce the recirculating stream to flow from the second port of the exhaust manifold to the cooling passage. It should be understood that in a typical system with which the present invention is used, two exhaust manifolds are similarly configured so that each of the two exhaust manifolds have first and second conduits to circulate water from the recirculating stream to the exhaust manifolds.

A preferred embodiment of the present invention further comprises the step of providing a lift pump for drawing water from a body of water in which the marine propulsion system is operating and inducing the water to flow into the cooling passage of the engine. The present invention can further comprise the steps of providing an exhaust conduit connected in fluid communication with the exhaust manifold, connecting a thermostat in fluid communication between the cooling passage of the engine and the exhaust conduit, purging water from the cooling passage through the thermostat as a function of the temperature of the water within the cooling passage, and directing water which is purged, as a function of the temperature of the water within the cooling passage, to the exhaust conduit. The exhaust conduit in marine propulsion systems of this type are generally referred to as exhaust elbows.

As will be described in greater detail below, the present invention comprises the steps of drawing water from a body of water, directing the water to flow into a cooling passage of an engine, creating a recirculating stream of cooling water which flows through the cooling passage, out of the cooling passage, and then back into the cooling passage, conducting a portion of the recirculating stream of cooling water through a first conduit to an exhaust manifold which is connected to an exhaust system of the engine and causing the water to flow from the exhaust manifold back into the recirculating stream of cooling water. When the water within the recirculating stream of cooling water achieves a predetermined temperature, a thermostat is used to selectively purge water from the recirculating stream, as a function of the temperature of that water, and conducting the purged water to an exhaust elbow which is attached in fluid communication with the exhaust manifold. A lift pump is used to draw the water from the body of water and a recirculation pump is used to create the recirculating stream of cooling water.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
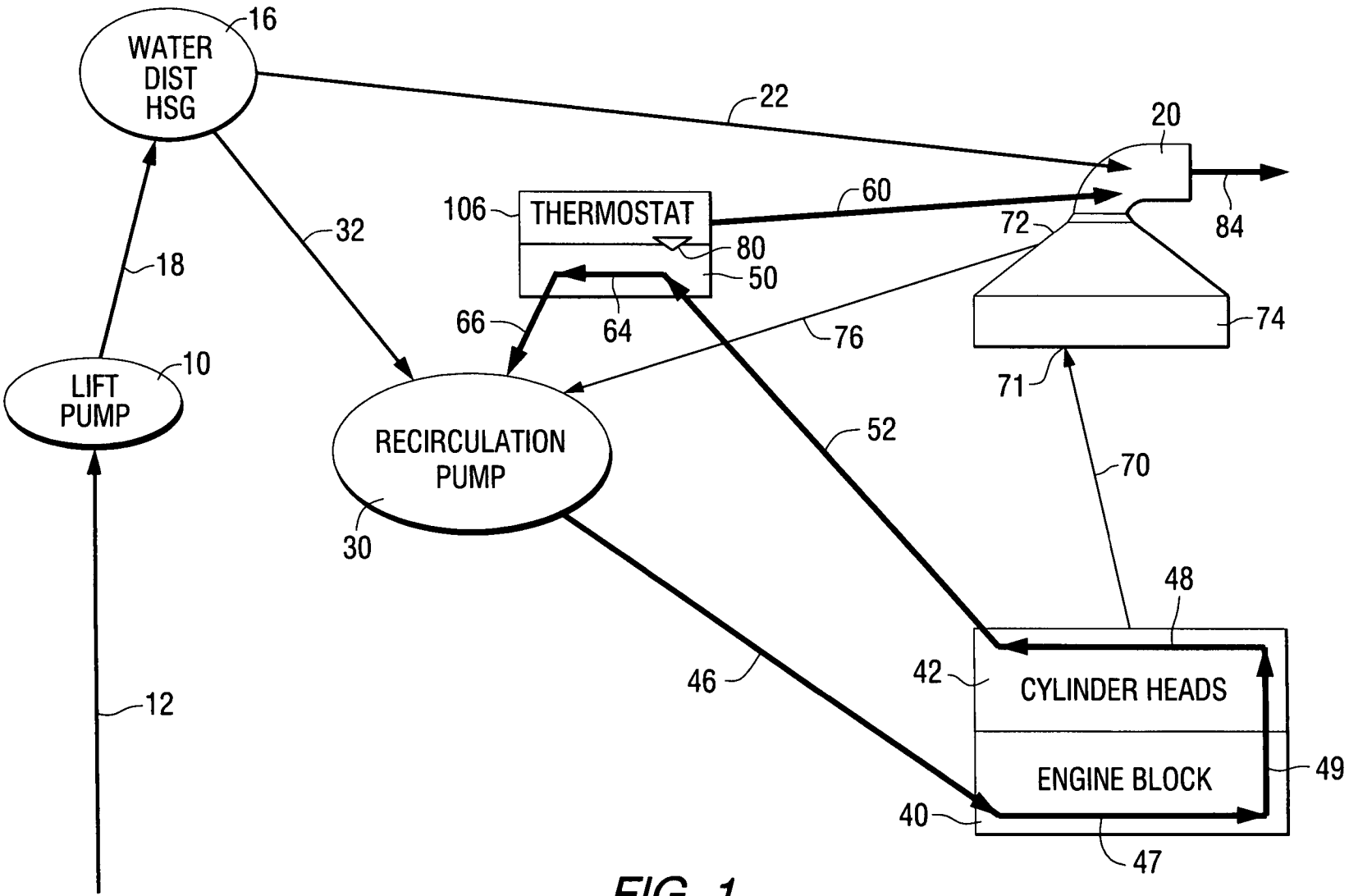
FIG. 1 is a simplified schematic representation of the present invention.

Throughout the description of the preferred embodiment of the present invention, like components will be identified by like reference numerals.

FIG. 1 is a simplified schematic representation of the cooling system of the present invention. A lift pump 10 draws water, as represented by arrow 12, from a body of water and pumps that water to a water distribution housing 16, as represented by arrow 18. A small portion of that water is directed from the water distribution housing 16 directly to the exhaust elbow 20, as represented by arrow 22. Most of the water entering the water distribution housing 16 is conducted to the recirculation pump 30, as indicated by arrow 32 in FIG. 1.

The recirculating pump creates a recirculating stream of cooling water that flows from the recirculation pump 30 to the engine block 40, and through the engine block 40 and the cylinder heads 42. The water flowing from the recirculation pump 30 to the engine block is represented by arrow 46. The water flowing through the cooling passage of the engine block is represented by arrow 47 and the water flowing through the cylinder heads 42 is represented by arrow 48. Arrow 49 represents a conduit through which water is internally directed from the engine block 40 to the cylinder heads 42. From the cylinder heads 42, the cooling water flows to a cavity 50, as represented by arrow 52. In a preferred embodiment of the present invention, the cavity 50 is part of a housing structure that also houses a thermostat 80 and associated passages that direct heated water through the thermostat and to the exhaust elbow 20, as represented by arrow 60.

With continued reference to FIG. 1 and the cavity 50, the cooling water from the cylinder heads 42 is conducted through the cavity, as represented by arrow 64, and back to the recirculation pump 30, as represented by arrow 66. The recirculating stream of cooling water flows along the path designated by arrows 46, 47, 49, 48, 52, 64, and 66.

A portion of the cooling water in the recirculating stream is conducted, as represented by arrow 70, to a first port 71 of an exhaust manifold 74. The water fills the cooling jacket of the exhaust manifold 74 and then exits from a second port 72, as represented by arrow 76, back to the recirculating stream of cooling water. More specifically, the water directed from the second port 72 flows to the recirculation pump 30 so that it can be reincorporated in the recirculating stream that continues to pass through the heat producing components of the engine.

With continued reference to FIG. 1, it can be seen that the first port 71 is located at a position which is lower than the second port 72. As the water flows in the direction represented by arrow 70, the cooling jacket of the exhaust manifold 74 fills with cooling water, from the bottom upwardly, until it exits from the second port 72. As a result, the cooling water flow, the temperature of the exhaust manifold 74, and the pressure within the exhaust manifold 74 are all balanced throughout the engine operating range. In other words, the flow of water into and through the exhaust jacket of the manifold 74 is not intermittent or discontinuous at any engine speeds. In addition, by directing a larger portion of the cooling water flow through the exhaust manifold 74 than in most known cooling systems, the increased cooling water flow stabilizes the temperature of the manifold 74. It should also be noted that the only water directed into the exhaust manifold cooling jacket is water that also flows through the heat producing components of the engine. As a result, this water quickly achieves a temperature of approximately 160 degrees Fahrenheit which is the typical temperature at which the thermostat valve 80 opens. Another advantage of the cooling circuit shown in FIG. 1 is that the exhaust elbow 20 is maintained at a generally warm temperature because of the flow of hot water through the thermostat valve 80, as represented by arrow 60, into the water flowing through the exhaust elbow 20 in combination with the water flowing into the exhaust elbow from the water distribution housing 16, as represented by arrow 22. This combined flow of water is returned to the body of water from which it was drawn, as represented by arrow 84.

Another advantage of the present invention is that the water flowing through the recirculating stream between the recirculation pump and the engine is increased in temperature at a more rapid rate because of the partial flow of that water through the exhaust manifold 74.

In order to more fully understand the operation of the present invention, it is helpful to understand the various rates of water flow that are used in a particularly preferred embodiment. As an example, the rate of flow caused by the lift pump 10, represented by arrows 12 and 18, is approximately twenty six gallons per minute. The water from the water distribution housing 16 to the recirculation pump, represented by arrow 32, is approximately eight gallons per minute. The recirculating stream of cooling water, represented by arrow 46, is approximately fifty gallons per minute. This rate of cooling water through the engine is then divided, with approximately ninety percent being conducted along the path represented by arrow 52 and approximately ten percent being conducted along the path represented by arrow 70 into the exhaust manifold 74. As a result, the two exhaust manifolds receive approximately 8.2 gallons per minute of cooling water through arrow 70 and the remaining 41.8 gallons per minute of cooling water flows along arrow 52 to be immediately returned to the recirculation pump 30 after passing through the cavity 50 of the thermostat housing. The ten percent of the cooling water flowing along arrow 70 to the exhaust manifold 74 travels through the cooling jacket of the exhaust manifold and returns along arrow 76 from the second port 72 back to the recirculation pump 30. The water flowing along arrow 60, before the thermostat valve 80 opens, is approximately one gallon per minute that results from a bleed water opening provided in the thermostat housing structure. After the thermostat valve 80 opens in response to increased temperature of the recirculating stream of cooling water, a greater flow of water passes along arrow 60 to the exhaust elbow 20 and that water is replenished by water drawn by the lift pump 10 from the body of water in which the marine vessel is operating.

Figure 2:
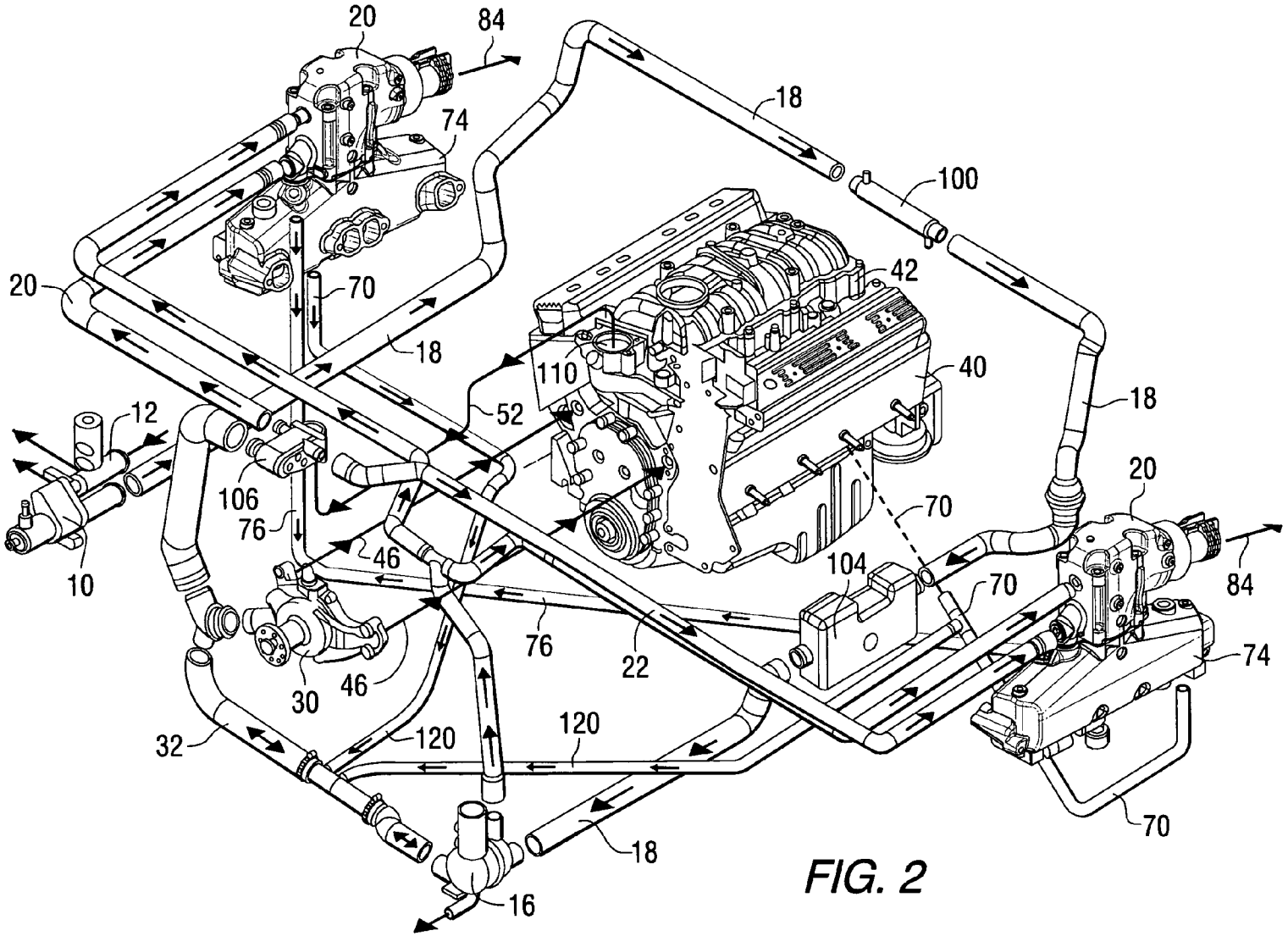
FIG. 2 is a partially exploded isometric view of a cooling system made in accordance with the present invention.

FIG. 2 is an isometric and partially exploded view of a cooling water system made in accordance with the present invention. The internal combustion engine is illustrated. It comprises the engine block 40 and the cylinder heads 42. The two exhaust manifolds 74 and exhaust elbows 20 are shown. The water distribution housing 16 and the sea water pump, or lift pump 10 are shown.

With reference to FIGS. 1 and 2, it should be understood that the arrows in FIG. 1 are represented by the conduits in FIG. 2 which are identified by like reference numerals.

The lift pump 10 draws water through conduit 12 from the body of water in which the system is operating. That water is then directed through conduit 18 to the water distribution housing 16. Connected serially in fluid communication between the lift pump 10 and water distribution housing 16 are a power steering cooler 100 and a fuel cooler 104. From the water distribution housing 16, water is directed to the recirculation pump 30 through conduit 32. The thermostat housing 106 receives water along path 52 from an exit port 110 of the engine. The recirculation pump 30 provides water along symmetrical parallel paths 46 into the engine block 40. Conduits 70 provide water from the engine block 40, and more particularly, from the recirculating stream of cooling water, to the first ports of the exhaust manifold 74 that are located near the bottom of the exhaust manifolds. After passing through the exhaust manifolds, the cooling water then flows through conduits 76 back to the recirculation pump 30. Some of the water flowing from the engine block 40 returns, through conduits 120 to conduit 32 so that it can be conducted expeditiously to the recirculation pump 30. Some of the water flowing through conduit 32 is directed to conduits 22 so that it can be conducted directly through the exhaust elbows 20.

With reference to FIGS. 1–2, it can be seen that the present invention provides a method for drawing water with a lift pump 10 from a body of water, directing the water flow into a cooling passage of an engine, creating a recirculating stream of cooling water, which comprises flow as represented by arrows 46, 47, 49, 48, 52, 64, and 66 in FIG. 1. It conducts a portion of the recirculating stream of cooling water, represented by arrow 70, through a first conduit to an exhaust manifold 74 which is connected to an exhaust system of the engine. It also causes the water to flow from the exhaust manifold 74 back into the recirculating stream of cooling water. The water entering the exhaust manifold 74 passes through a first port 71 and exits through a second port 72, wherein the second port 72 is above the first port 71. A thermostat valve 80 is provided to selectively purge the water from the recirculating stream of cooling water as a function of the temperature of the water and this purged water is conducted by the thermostat to an exhaust elbow 20 which is attached in fluid communication with the exhaust manifold 74. The drawing step is performed by a lift pump 10 and the creating step is performed by a recirculation pump 30 which is connected in fluid communication with the cooling passages of the engine. The present invention further provides a water distribution housing 16 and directs the water through the water distribution housing 16 and subsequently into the recirculating stream of cooling water. Although the primary benefits of the present invention include a more uniform cooling of the exhaust manifold 74 and the more rapid heating of the cooling water within the engine, it can be seen that other advantages are also inherent in the design of the present invention.

Although the present invention has been described in particular detail and illustrated to show a preferred embodiment, it should be understood that alternative embodiments are also within its scope.

We claim:

1. A method for cooling a marine propulsion system, comprising:

providing an engine;

providing an exhaust manifold to direct exhaust gases away from said engine;

providing a recirculation pump connected in fluid communication with a cooling passage of said engine;

creating a recirculating stream of cooling water which flows into said cooling passage from said recirculation pump, through said cooling passage, and out of said cooling passage back to said recirculation pump;

connecting said cooling passage of said engine in fluid communication with a first port of said exhaust manifold to direct a first portion of said recirculating stream of cooling water into said first port of said exhaust manifold;

connecting a second port of said exhaust manifold in fluid communication with said cooling passage of said engine to direct said first portion of said recirculating stream from said second port of said exhaust manifold back into said recirculating stream of cooling water, said first port being disposed below said second port;

sensing a temperature of said water in said cooling passage; and directing said water to flow from said cooling passage to an exhaust elbow when said temperature exceeds a preselected temperature.

2. A method of claim 1, further comprising:

causing a first stream of water to flow from said cooling passage of said engine to said first port of said exhaust manifold.

3. A method of claim 2, further comprising:

causing a second stream of water to flow from said second port of said exhaust manifold to said cooling passage of said engine.

4. A method of claim 2, wherein:

said causing step is performed by a recirculation pump.

5. A method of claim 3, wherein:

both causing steps are performed by a recirculation pump.

6. A method of claim 1, further comprising:

drawing water from a body of water; and pumping said water into said cooling passage.

7. A method of claim 1, further comprising:

providing a thermostat.

8. A method for cooling a marine propulsion system, comprising the steps of:

providing an engine;

providing a cooling passage formed within said engine;

attaching an exhaust manifold to an exhaust system of said engine;

connecting a first conduit in fluid communication between said cooling passage and a first port of said exhaust manifold;

connecting a second conduit in fluid communication between a second port of said exhaust manifold and said cooling passage, said first port being below said second port;

creating a recirculating stream of cooling water to flow into said cooling passage, through said cooling passage, and out of said cooling passage;

causing water to flow through said first conduit from said recirculating stream to said first port;

causing water to flow through said second conduit from said second port to said cooling passage;

providing a recirculation pump connected in fluid communication between said second port and said cooling passage to induce said recirculating stream to flow from said second port to said cooling passage;

providing a lift pump for drawing water from a body of water in which said marine propulsion system is operating and inducing said water to flow into said cooling passage;

providing an exhaust conduit connected in fluid communication with said exhaust manifold;

connecting a thermostat in fluid communication between said cooling passage and said exhaust conduit;

purging water from said cooling passage through said thermostat as a function of a temperature of said water within said cooling passage; and directing water which is purged, as a function of said temperature of said water within said cooling passage, to said exhaust conduit.

* * * * *